US006371226B1

(12) United States Patent
Caraway

(10) Patent No.: US 6,371,226 B1
(45) **Date of Patent: *Apr. 16, 2002**

(54) DRAG-TYPE ROTARY DRILL BIT

(75) Inventor: Douglas Caraway, Kingwood, TX (US)

(73) Assignee: Camco International Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/447,059

(22) Filed: Nov. 22, 1999

Related U.S. Application Data

(60) Provisional application No. 60/110,853, filed on Dec. 4, 1998.

(51) Int. Cl.[7] ..... F21B 10/36

(52) U.S. Cl. ..... 175/420.2; 175/415; 175/434

(58) Field of Search ..... 175/415, 420.1, 175/420.2, 430, 431, 434

(56) References Cited

U.S. PATENT DOCUMENTS

| | | | | |
|---|---|---|---|---|
| 3,058,535 A | | 10/1962 | Williams, Jr. | |
| 3,106,973 A | | 10/1963 | Christensen | |
| 3,135,341 A | | 6/1964 | Ritter | |
| 3,153,458 A | | 10/1964 | Short | |
| 3,537,538 A | | 11/1970 | Generoux | |
| 3,709,308 A | | 1/1973 | Rowley et al. | |
| 4,128,136 A | | 12/1978 | Generoux | |
| 4,491,188 A | * | 1/1985 | Grappendorf | 175/329 |
| 4,932,484 A | * | 6/1990 | Warren et al. | 175/329 |
| 5,531,281 A | * | 7/1996 | Murdock | 175/431 |
| 5,582,261 A | * | 12/1996 | Keith et al. | 175/431 |
| 5,607,025 A | * | 3/1997 | Mensa-Wilmot et al. | 175/431 |
| 6,193,000 B1 | * | 2/2001 | Caraway et al. | 175/431 |

FOREIGN PATENT DOCUMENTS

| | | |
|---|---|---|
| EP | 0 314 953 | 5/1989 |
| EP | 0 554 568 | 8/1993 |
| FR | 1555163 | 1/1969 |

OTHER PUBLICATIONS

European Search Report, dated Jul. 25, 2000, relative to EP 1 006 257 A3.

* cited by examiner

*Primary Examiner*—David Bagnell
*Assistant Examiner*—Jennifer R. Dougherty
(74) *Attorney, Agent, or Firm*—Jeffery E. Daly

(57) ABSTRACT

There is provided a rotary drag-type drill bit comprising a bit body having a leading surface comprising a plurality of pads, at least some of the pads each having a wearable abrasive surface including particles of superhard material and defining an outer profile of the pad, at least a part of the outer profile of at least one of the pads being disposed inwardly or outwardly of the outer profile of the other pads. With this arrangement, during initial drilling through softer formation, most of the removal of formation will be effected by the outermost of the abrasive pads and little or no formation will be removed by the more inward pads. Accordingly, the bit will act as a lighter set bit and good rates of penetration may be achieved. As drilling proceeds and the bit wears, which may occur more rapidly as the bit meets harder formations, the more outwardly disposed pads will wear down more than the inwardly disposed pads so that the inwardly disposed pads will begin to contribute more to the cutting action of the bit, so that the bit effectively becomes heavier set. As drilling progresses to a point where all of the pads wear down to the same level, the bit will then act as a conventional heavy set bit where all the abrasive surfaces lie on the same profile.

16 Claims, 4 Drawing Sheets

DRAG-TYPE ROTARY DRILL BIT

This appln claims benefit of 60/110,853 filed Dec. 4, 1998.

BACKGROUND OF THE INVENTION

1. Field of the Invention

The invention relates to rotary drag-type drill bits for drilling in subsurface formations. In particular, the invention is a rotary drag-type drill bit with wearable pads formed of an impregnated diamond/matrix material.

2. Description of Related Art

Diamond impregnated bits may be generally described as being of the kind comprising a bit body having a leading surface comprising a plurality of pads separated by channels for drilling fluid, at least some of the pads each having an abrasive surface including particles of superhard material. The particles of superhard material may be natural or synthetic diamonds, or small bodies of polycrystalline diamond, set in the outer surface of a pad, or the pad may include an outer layer impregnated with superhard particles which, again, may be natural or synthetic diamonds or particles of polycrystalline diamond. It is also possible to combine the two arrangements. Such bits are particularly suitable for drilling through harder subsurface formations.

Hitherto, it has been the usual practice for all parts of the abrasive surfaces of the pads to lie on the same profile. That is to say, at each longitudinal position on the bit, all points on the surfaces of the pads are at the same radius with respect to the central longitudinal axis of the bit. Accordingly, during drilling all of the abrasive surfaces of the bit act on the formation being drilled simultaneously.

In many applications, a lighter set bit (i.e., a bit having fewer superhard particles disposed over the surface of the bit) would be preferable when drilling the upper part of the formation, but a heavier set bit is actually used since such a bit will be required in order to drill through the harder formations likely to be met deeper in the borehole. As a result of having to use the heavy set bit in the softer formations near the surface, the rate of penetration (ROP) of the bit may be lower than that could be achieved by using a lighter set bit.

The present invention therefore sets out to provide a rotary drill bit of the above-mentioned type where the same bit can act as a lighter set bit during initial drilling, but can act as a more heavily set bit as drilling proceeds.

SUMMARY OF THE INVENTION

According to the invention there is provided a rotary drag-type drill bit comprising a bit body having a leading surface comprising a plurality of pads separated by channels for drilling fluid, at least some of the pads each having a wearable abrasive surface including particles of superhard material and defining an outer profile of the pad, at least a part of the outer profile of at least one of the pads being disposed inwardly or outwardly of the outer profile of the other pads.

In this specification, for convenience, terms such as "inwardly" and "outwardly" or "inner" and "outer" refer to positions relative to the center of the bit body; i.e., a point lying on the central longitudinal axis of rotation of the bit.

With this arrangement, during initial drilling through softer formation, most of the removal of formation will be effected by the outermost of the abrasive pads and little or no formation will be removed by the more inward pads.

Accordingly, the bit will act as a lighter set bit and good rates of penetration may be achieved.

However, as drilling proceeds and the bit wears, which may occur more rapidly as the bit meets harder formations, the more outwardly disposed pads will wear down more than the inwardly disposed pads so that the inwardly disposed pads will begin to contribute more to the cutting action of the bit, so that the bit effectively becomes heavier set. As drilling progresses to a point where all of the pads wear down to the same level, the bit will then act as a conventional heavy set bit where all the abrasive surfaces lie on the same profile.

The overall profile of a set of inner pads may be generally similar to the overall profile of a set of outer pads, the profiles merely being displaced relatively to one another, for example relatively displaced in the direction of the longitudinal axis of the drill bit.

The abrasive surface of any of the pads may be smoothly and continuously curved so that the outer profile defined by the pad surface follows the contour of the surface itself. Alternatively, the abrasive surface of a pad may comprise higher and lower regions, in which case the outer profile is defined by the higher regions of the pad surface, the lower regions lying inwardly of the outer profile.

Preferably, the drill bit includes a plurality of pads having outer profiles which are disposed inwardly or outwardly of the outer profiles of the other pads, so that under all conditions a plurality of pads engage the formation. For example, some pads may have outer profiles which together define a reference profile, the bit including pads having outer profiles lying inwardly of the reference profile as well as pads having outer profiles lying outwardly of the reference profile.

In known manner, the pads may extend outwardly away from the central longitudinal axis of the bit towards the outer periphery thereof. In this case the outer profile of each pad may be displaced inwardly or outwardly with respect to the profile of the pad on the leading and/or trailing side thereof with respect to the normal direction of rotation of the drill bit. Each pad may extend generally radially outwards from the central longitudinal axis of the bit or may be offset forwardly or rearwardly of a radius of the bit, with respect to the direction of normal rotation of the bit. For example, each pad may extend away from the axis in a spiral.

In any of the above arrangements the outer profiles of the pads, at the outer periphery of the bit, are preferably equidistant from the central longitudinal axis of rotation of the bit so that all of the pads engage the side walls of the borehole.

In any of the above arrangements the particles of superhard material may be set in the outer surface of a pad or the pad may include an outer layer impregnated with superhard particles. Such arrangements may be combined by some pads having particles set in their outer surface while other pads include an outer layer impregnated with superhard particles. Arrangements are also possible where the pad includes both an outer layer impregnated with superhard particles and additional superhard particles set in the outer surface of the impregnated layer.

The superhard particles may be, but are not limited to, natural diamonds, synthetic diamonds, or bodies of polycrystalline diamond material. Where the particles are of polycrystalline diamond they preferably comprise but not limited too thermally stable polycrystalline diamond material.

In known manner, the bit body, or at least the part thereof forming the pads, may be formed from solid infiltrated matrix material.

In known drill bits of the kind first referred to, it is usual for all parts of the surface of each pad to lie on the overall cutting profile of the drill bit so that all parts of the abrasive surface of each pad engage the formation. While such an arrangement may be preferred when drilling some types of formation, some other types of formation may not be efficiently cut by abrasive pads of such configuration. According to another aspect of the invention, therefore, the outer surfaces of the pads are configured in a manner to enhance the cutting effectiveness of the pads with a wider variety of types of formation.

According to this aspect of the invention there is provided a rotary drill bit comprising a bit body having a leading surface comprising a plurality of pads extending outwardly away from the central longitudinal axis of the bit and separated by channels for drilling fluid, at least some of the pads each having an abrasive surface including particles of superhard material, the abrasive surfaces of at least some of the pads being so shaped in circumferential cross-section that some portions of the abrasive surface are disposed inwardly or outwardly of other portions of the surface; i.e. not all portions of the abrasive surface of the pad are at the same radius from the bit axis and do not therefore all lie on the overall cutting profile of the bit.

For example, the surface of a pad may have at least a portion which is inclined to face partly forwardly or rearwardly with respect to the normal direction of rotation of the drill bit, or opposed portions which are inclined to face in both such directions.

Alternatively, the surface of a pad may be formed with alternating ribs and grooves extending along the pads as they extend away from the central longitudinal axis of the drill bit. The ribs and grooves may be generally curved, triangular or rectangular in cross-section, or any combination of these or other shapes.

In an alternative arrangement the surface of a pad may be concavely or convexly curved in circumferential cross-section, the curvature being of smaller radius than the curvature of the overall cutting profile of the drill bit at the location of the cross-section of the pad.

The above described feature of shaping of the cross-section of the pads may be combined with any of the other features of the invention previously referred to.

DETAILED DESCRIPTION OF THE PREFERRED EMBODIMENTS

Figure 1:
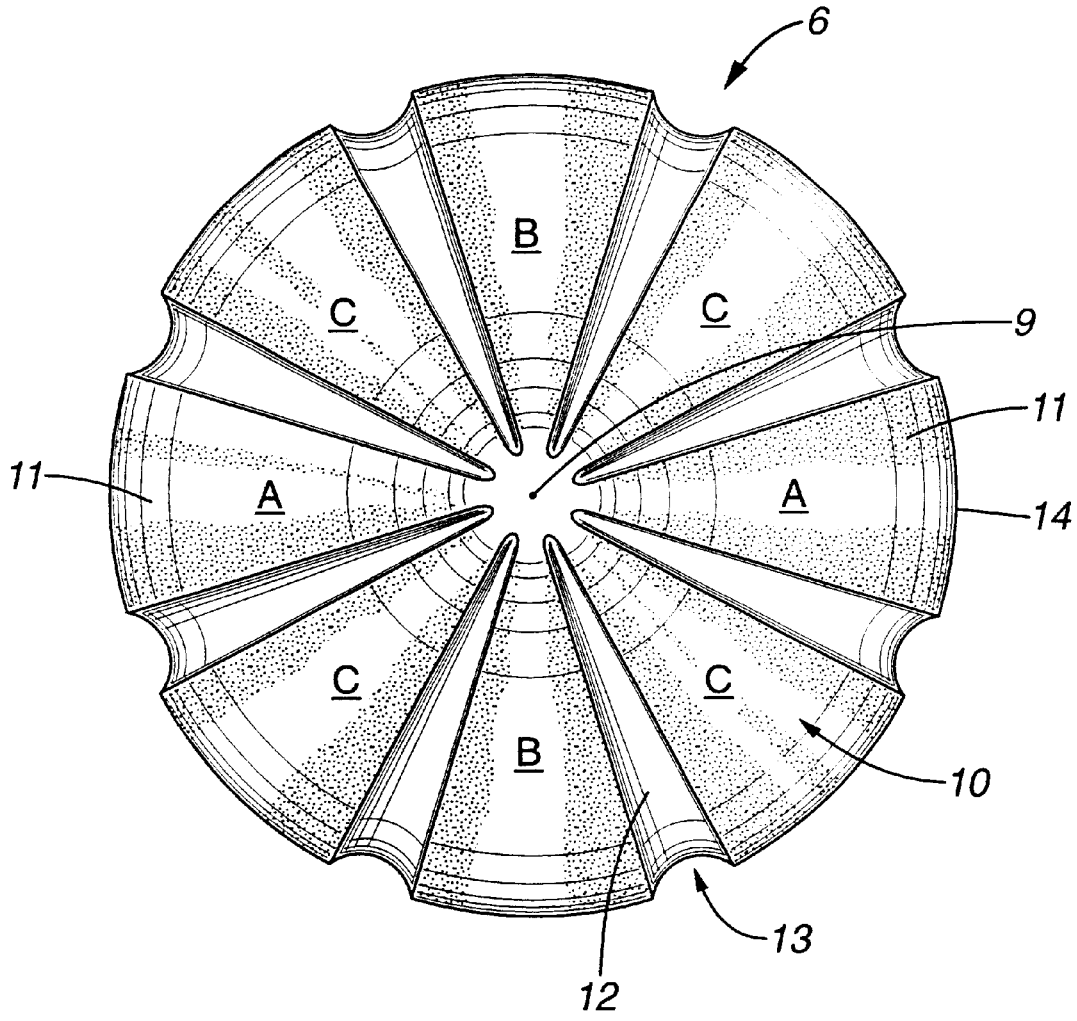
FIG. 1 is a diagrammatic end view of the leading face of an impregnated drill bit in accordance with the present invention.

Referring to FIG. 1, a rotary drag-type drill bit 6 has a leading surface 10 on the main body 8 of the bit, the leading surface being formed with a plurality of wearable, outwardly extending pads 11 separated by flow channels 12 for drilling fluid which lead to junk slots 13 at the outer periphery of the bit. The junk slots extend generally axially upwardly across the gauge portion 14 of the drill bit.

An outer surface layer of each pad 11 is impregnated in known manner with a large number of abrasive particles of superhard material (not shown) which may be natural or synthetic diamond. For example, the diamond particles may be of a size in the range of from 2–1000 particles/carat. The diamond impregnated layer may for example have a thickness in the range of 3–25 mm.

In known manner, the bit body is molded, using a powder metallurgy process, and the diamond particles are impregnated into the surface of the bit body by applying a layer of tungsten carbide paste, or premolded parts in which the particles are suspended, to the interior surface of the mold along surfaces corresponding to the lands 11. The paste may be formed with the tungsten carbide, the particles and other materials mixed with an organic binder or other form of binder material. Strips of clay or other suitable mold material are also applied to the interior surface of the mold to define the waterways 10. The mold is then packed with dry particulate tungsten carbide or equivalent material. The mold is then placed in a furnace where a suitable copper or other alloy is infiltrated downwardly though the carbide particles so as to form, upon cooling, a body of solid infiltrated matrix material in the shape of the mold, and having diamond particles embedded in its outer surface. This method of construction of impregnated drill bits is well known in the art and will not therefore be described in further detail.

Although the invention is particularly applicable to impregnated drill bits, it may also be applicable to drill bits where larger natural or synthetic diamonds are set in the outer surface of the pads on the bit body.

In prior art bits of the kind to which the invention relates, the outer surfaces of all of the abrasive pads 11 lie on the same overall common cutting profile of the drill bit so that, during drilling, all of the pads act on the formation simultaneously.

Figure 2:
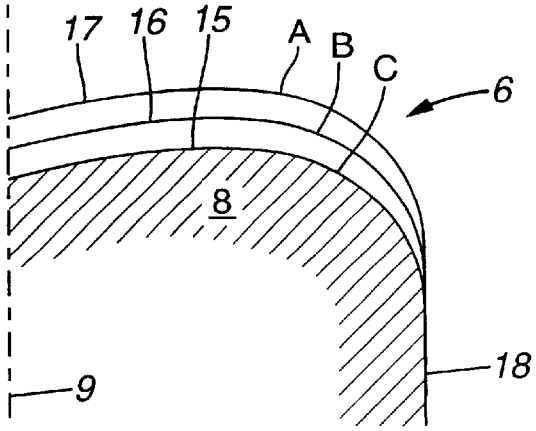
FIG. 2 is a diagrammatic representation of the cutting profiles of three different types of abrasive pad on the drill bit.

In accordance with the present invention, however, some of the pads 11 have outer profiles which are at different locations with respect to the bit body, and one such arrangement is shown diagrammatically in FIG. 2, where the reference 9 indicates the central longitudinal axis of rotation of the drill bit. The outermost of the abrasive pads 11 with respect to the bit body define a leading surface 17, 21, 22, 30 of the bit 6 as it rotates about its central longitudinal axis 9.

As may be seen from FIG. 2, a set of four of the pads 11, indicated at C in FIGS. 1 and 2, have an outer cutting profile 15. A set of two of the pads, indicated at B in FIGS. 1 and 2, have an outer cutting profile 16 which is disposed outwardly of the cutting profile 15 of the pads C, and is distinct from the cutting profile 15 of pass C. A further pair of pads, indicated at A, in FIGS. 1 and 2, have an outer cutting profile 17 which is disposed outwardly of both the cutting profiles 15 and 16, and is distinct from both. The outer cutting profile 17 of the pads 11 in set A form the leading surface of the bit.

Although the cutting profiles are spaced apart along most of their length, it will be seen from FIG. 2 that they converge so as to become of the same diameter at the outer periphery of the drill bit, as indicated at 18 in FIG. 2 but not necessarily at the same height. This ensures that the overall diameter of the borehole being drilled remains constant irrespective of differential wear of the pads.

A useful feature of the abrasive impregnated pads 11 is that the pads 11 are wearable. As the cutting surface wears, new abrasive cutting elements are exposed. The result is that, even though worn, the cutting surface continues to remove formation at the same cutting rate as an unworn cutting surface.

During initial drilling most of the removal of formation will be effected by the two outermost abrasive pads marked A and therefore comparatively high ROP can be achieved in the softer formation. As drilling continues, the pads A begin to wear while remaining equally effective in formation removal as when new, as new abrasive particles are continuously exposed at the surface of the pads A. The pads A have a substantially constant abrasive area as they wear.

This behavior is the opposite from non-impregnated diamond containing drag-type drill bits. When the cutting surfaces of non-impregnated diamond containing drag-type drill bits wear, even a relatively small amount, the exposed surface loses its ability to effectively remove formation and acts more as a formation bearing element rather than as a formation removing element. As opposed to the present invention, these would be considered non-wearable surfaces.

As the pads A wear down, the next inner pads B increasingly come into play so as to increase the abrasive area acting on the formation in a manner more appropriate to harder formations. As wear continues and pads A and B will wear down to the level of the innermost pads C, all of the pads will remove formation and the bit will act as a heavy set bit suitable for drilling the harder formations likely to be met at greater depth. During operation, each set of pads A, B, C each have a substantially constant abrasive area as they wear. However, the total abrasive area of the bit increases incrementally, first as set B of the pads, and later as set C of the pads, begin to remove formation.

It will be appreciated that any number of different sets of pads having cutting profiles at different positions may be provided, although two to five such sets are preferred. The different cutting profiles may be distributed in any manner between the pads on the drill bit, although symmetrical distributions are preferred, such as shown in FIG. 1, to ensure that stability of the bit as it rotates is maintained, regardless of how many pads are actually acting on the formation. Assymetric distributions may be used for some applications. Although a total of eight generally radially extending pads are shown in FIG. 1, it will be appreciated that any number and configuration of pads may be employed, for example the pads may be of any of the configurations used in the prior art, but with the difference that, according to the invention, the outer profiles of different sets of pads are at different positions relative to the bit body.

FIG. 3 shows a modified version of the arrangement of FIG. 2 where the profiles of the three sets of pads, instead of converging gradually towards the outer periphery of the drill bit, are stepped, as indicated at 19 in FIG. 3, again to ensure that the cutting profiles of the sets of pads are equidistant from the central longitudinal axis 9 at the periphery of the bit, thereby ensuring that the diameter of the borehole does not vary significantly with differential wear of the pads.

Figure 3:
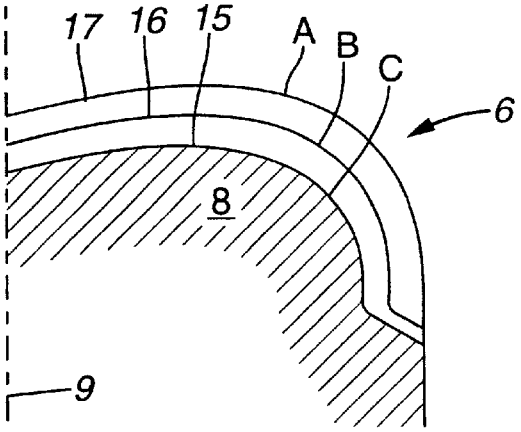
FIG. 3 is a similar view to FIG. 2 of alternative shapes of profile.

In the arrangements of FIGS. 2 and 3, the outer abrasive surfaces of the pads are smoothly curved as they extend outwardly away from the central longitudinal axis of the bit and consequently the outer cutting profiles of the pads follow and are close to the surface contours of the pads themselves.

As previously mentioned, however, the outer surfaces of the pads may not be smoothly and continuously curved but may comprise higher and lower regions, in which case, the outer profile is defined by the higher regions of the surface, the lower regions lying inwardly of the outer profile. Such an arrangement is shown diagrammatically in FIG. 4 where the pads C having the innermost cutting profile 20 have a surface profile which undulates as it extends outwardly away from the central longitudinal axis 9 of the drill bit. The cutting profile 20 extends thus across the tops of the undulations.

The intermediate pads B are smoothly and continuously curved so that their cutting profile follows the actual surface of the pads. The pads A, having the outermost cutting profile 21, have a generally saw tooth configuration along their length.

In an example of this embodiment of the invention, an 8⅜ inch (213 mm) 642 type diamond impregnated bits made by Reed-Hycalog, has a total of fifteen pads 11 arranged in a configuration similar to FIGS. 1 and 2. In the 642 type bit there are five pads in set A, five pads in set B and five pads 11 in set C. The pads 11 of set A in this bit are disposed outwardly by 2 mm from the pads 11 of set B. The pads 11 of set C in this bit are disposed outwardly by 2 mm from the pads 11 of set C. This bit is designed to run in the Naricual formation, in Venezuela. In this region the very hard and abrasive formations in the interval from about 15,000 feet (4572 meters) deep to about 16,500 feet (5029 meters) deep typically took about 150–300 hours of drilling time to drill. In many cases, several drill bits were required to drill this interval.

A 642 type bit of the present invention is typically run in this formation at 1200 RPM with an applied drilling weight of 8000 pounds (3629 kg.). The bit initially drills the upper part of this formation with only the five pads in set A. In this operating condition, the bit can drill about 0.05 mm of the formation per bit revolution. As the bit drills, the pads 11 continually wear at a known rate.

The wear rate of the bit is determined by the size and type of diamond grit, and the concentration of the diamond grit in the matrix. The bit designer adjusts these to cause the bit to wear in a known manner. Oftentimes, the adjustments are so precise, bits run in adjacent boreholes will have differing diamond grit constituencies. Although not a requirement, all the pads 11 of the matrix on the bit in this example have the same diamond constituencies.

In the present example, the diamonds particles are a relatively coarse 0.5 mm average diameter with a concentration of 50%–55%. With this constituency, the pads A wear about 2 mm in 500 feet (152 meters) of drilling. At this point, the five pads in set B join the five pads in set A for a total of ten pads removing formation. With 10 pads in contact, the bit now drills only about 0.03 mm/revolution. After about 500 more feet (152 meters) of drilling, the pads of set A and set B have worn an additional 2 mm so that now all 15 pads of sets A, B and C join to drill the borehole to its final depth. With all 15 pads in contact the bit drills only about 0.01 mm/revolution.

A single 642 type bit of the present example is expected to drill this interval in 100–150 hours. The wearable pads 11 allow the bit to drill relatively quickly in the less tough, upper section of the interval. As the formation becomes progressively denser, tougher and more abrasive in the middle and lower sections, more of the pads 11 come in contact with the formation as the pads wear. A characteristic of the bit is that the drilling rate does not significantly change as the sets of pads in contact with the formation wear. Instead, the drilling rate changes only when the wear causes additional pads to contact the formation.

In a second example, an 8½ inch (216 mm) 672 type diamond impregnated bit made by Reed-Hycalog, has a total of twenty-four pads 11 arranged in a configuration similar to FIGS. 1 and 2. In the 642 type bit there are eight pads in set A, eight pads in set B and eight pads 11 in set C. The pads 11 of set A in this bit are disposed outwardly by 1.0 mm from the pads 11 of set B. The pads 11 of set B in this bit are disposed outwardly by 1.0 mm from the pads 11 of set C. This bit is designed to run in the Mirador formation, in Columbia. In this region the very hard and abrasive formations in the interval from about 16,000 feet (4877 meters) deep to about 16,500 feet (5029 meters) deep typically took about 60–100 hours of drilling time to drill. In many cases, several drill bits were required to drill this interval.

A 642 type bit of the present invention is typically run in this formation at 600 RPM with an applied drilling weight of 8000 pounds (3629 kg). The bit initially drills the upper part of this formation with only the five pads in set A. In this operating condition, the bit can drill about 0.04 mm of the formation per bit revolution. As the bit drills, the pads 11 continually wear at a known rate.

In the present example, the diamonds particles are a relatively coarse 0.4 mm average diameter with a concentration of 50%–55%. With this constituency, the pads A wear about 1 mm in 100 feet (30 meters) of drilling. At this point, the eight pads in set B join the eight pads in set A for a total of sixteen pads removing formation. With sixteen pads in contact, the bit now drills only about 0.03 mm/revolution. After about 200 more feet (60 meters) of drilling, the pads of set A and set B have worn an additional 1 mm so that now all twenty-four pads of sets A, B and C join to drill the borehole to its final depth. With all twenty-four pads in contact the bit drills only about 0.01 mm/revolution.

A single 672 type bit of the present example is expected to drill this interval in 40–80 hours. The wearable pads 11 allow the bit to drill relatively quickly in the less tough, upper section of the interval. As the formation becomes progressively denser, tougher and more abrasive in the middle and lower sections, more of the pads 11 come in contact with the formation as the pads wear. Again, the drilling rate changes only when the wear of the pads cause additional pads to contact the formation.

Figure 4:
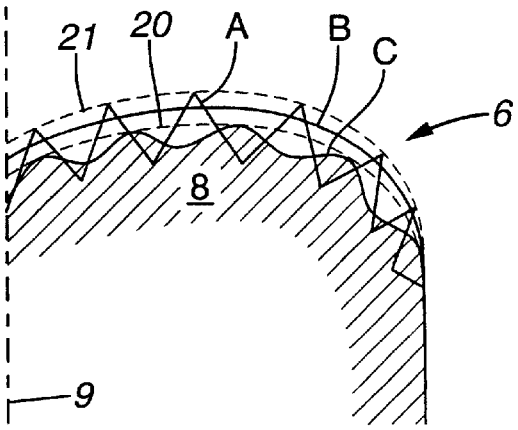
FIG. 4 is a further view showing alternative shapes of profile.

A second embodiment of the invention is shown in FIGS. 4–12. FIG. 4 shows only diagrammatically the principle that the actual surfaces of the pads do not require to be smoothly and continuously curved.

Figure 5:
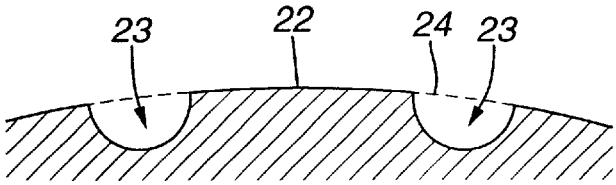
FIG. 5 (Prior Art)
FIG. 5 is a circumferential cross-section through an abrasive impregnated pad in a prior art impregnated drill bit.

FIG. 5 shows diagrammatically a circumferential cross-section through a radial pad of a conventional prior art impregnated drill bit. The outer surface of the pad, which abrades the formation, is indicated at 22 and the channels or waterways along each side of the pad are indicated at 23.

As may be seen from FIG. 5, in the conventional prior art arrangement the circumferential profile of the pad is smoothly curved at the same radius as the overall cutting profile of the drill bit as a whole, which is indicated at 24. Consequently this means that the whole of the outer abrasive surface of the pad acts on the formation simultaneously.

As previously mentioned, however, according to another aspect of the present invention it has been discovered that impregnated drill bits can be made to cut a wider variety of different formations efficiently by configuring the circumferential cross-sectional shape of the pads so that not all of the pad acts on the formation at the same time. Typical configurations in accordance with the invention are shown diagrammatically in FIGS. 6–12.

Figure 6:
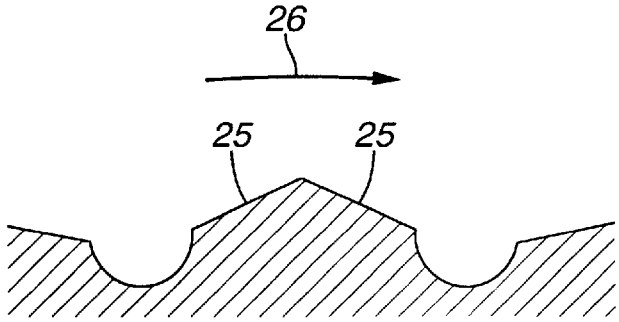
FIGS. 6–12 are similar diagrammatic cross-sections through alternative shapes of abrasive pad in accordance with the present invention.

In the arrangement of FIG. 6 the outer surface of the pad is shaped to provide two inclined surfaces 25 facing respectively forwardly and rearwardly with reference to the normal direction of rotation of the drill bit during drilling, as indicated by the arrow 26.

Figure 7:
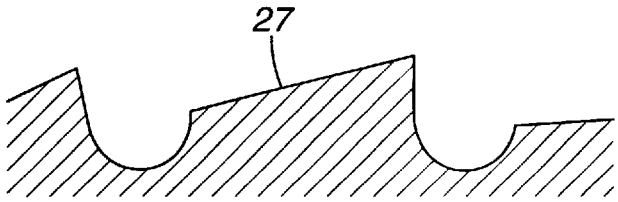
Figure 8:
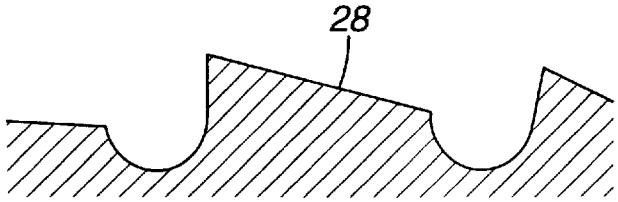

In the arrangement of FIG. 7 the single surface 27 of the pad is inclined to face rearwardly while in FIG. 8 the surface 28 of the pad faces forwardly.

Figure 9:
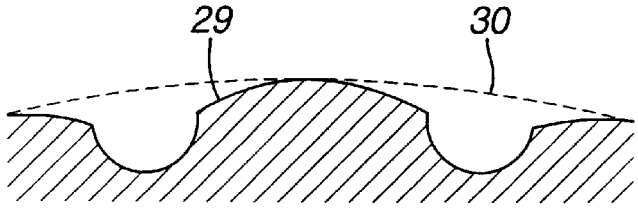

In FIG. 9 the outer surface 29 of the pad is convexly curved in cross-section but the radius of curvature of the pad is significantly smaller than the radius of curvature of the overall cutting profile 30 of the drill bit so that not all of the surface 29 acts on the formation simultaneously.

Figure 10:
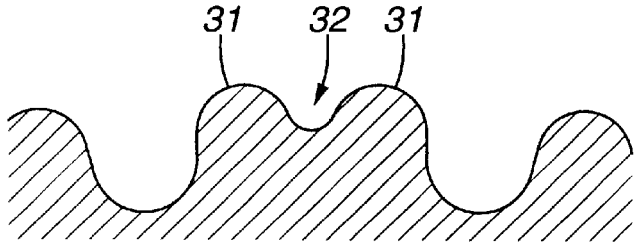

In the arrangement of FIG. 10 the outer surface of the pad is formed with two longitudinal convexly curved ribs 31 separated by a groove 32.

Figure 11:
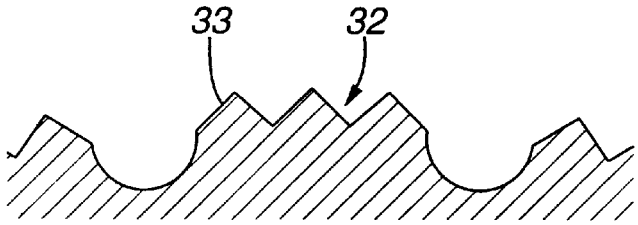

In FIG. 11 three generally triangular ribs 33 on the pad are separated by triangular grooves 34.

Figure 12:
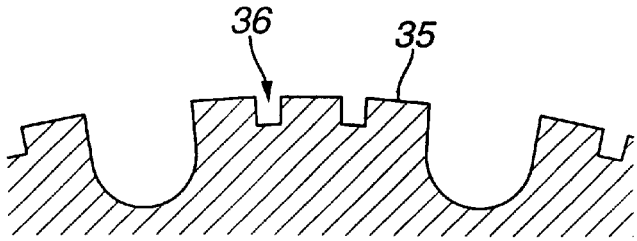

In the arrangement of FIG. 12 three generally rectangular ribs 35 on the pad are separated by rectangular grooves 36.

In all of the arrangements of FIGS. 6–12 the effective surface area of the pads will increase as the pads wear, with the result that the pads will effectively become heavier set as wear occurs, which is desirable for the reasons previously explained.

Whereas the present invention has been described in particular relation to the drawings attached hereto, it should be understood that other and further modifications, apart from those shown or suggested herein, may be made within the scope and spirit of the present invention.

What is claimed is:

1. A rotary drag-type drill bit comprising a bit body having a central longitudinal axis, a leading surface, and a plurality of wearable pads separated by a plurality of flow channels for a drilling fluid, the wearable pads impregnated with particles of a superhard material and having an abrasive surface, a first set of the wearable pads forming a first outer profile, the first outer profile forming the leading surface of the drill bit, a second set of the wearable pads forming a second outer profile distinct from the leading surface of the bit, the second outer profile being disposed inwardly with respect to the bit body along the central longitudinal axis, from the leading surface of the bit, wherein a total abrasive area of the drill bit increases incrementally during operation.

2. The rotary drag-type drill bit of claim 1 wherein the superhard material is diamond.

3. The rotary drag-type drill bit of claim 2 wherein the diamond comprises natural diamond of a size of from about 2 to about 1000 diamonds per carat.

4. The rotary drag-type drill bit of claim 2 wherein the diamond comprises polycrystalline diamond.

5. The rotary drag-type drill bit of claim 1 wherein a third set of the wearable pads form a third outer profile intermediate the second outer profile and the leading surface of the bit.

6. The rotary drag-type drill bit of claim 5 wherein the third outer profile is displaced from the second outer profile by at least about 1 mm.

7. The rotary drag-type drill bit of claim 1 wherein the second outer surface is displaced from the leading surface of the bit by at least about 2 mm.

8. A rotary drag-type drill bit comprising a bit body having a central longitudinal axis, a leading surface, an outer periphery, and a plurality of wearable pads separated by a plurality of flow channels for a drilling fluid, the wearable pads impregnated with particles of a superhard material and having an abrasive surface, a first set of the wearable pads forming a first outer profile, the first outer profile forming the leading surface of the drill bit, a second set of the wearable pads forming a second outer profile distinct from the leading surface of the bit, the second outer profile being disposed inwardly with respect to the bit body along the central longitudinal axis, from the leading surface of the bit, wherein a total abrasive area of the drill bit increases incrementally during operation, and the second outer profile and the leading surface of the bit converge at the outer periphery of the bit.

9. The rotary drag-type drill bit of claim 8 wherein the superhard material is diamond.

10. The rotary drag-type drill bit of claim 9 wherein the diamond comprises natural diamond of a size of from about 2 to about 1000 diamonds per carat.

11. The rotary drag-type drill bit of claim 8 wherein a third set of the wearable pads form a third outer profile intermediate the second outer profile and the leading surface of the bit, the third outer profile, the second outer profile and the leading surface of the bit all converge at the outer periphery of the bit.

12. A rotary drag-type drill bit comprising a bit body having a central longitudinal axis, a leading surface, and a plurality of wearable pads separated by a plurality of flow channels for a drilling fluid, the wearable pads having an abrasive surface, a first set of the wearable pads having a first wear area and forming a first outer profile, a second set of the wearable pads having a second wear area and forming a second outer profile distinct from first outer profile, wherein, during operation a total abrasive area of the drill bit increases incrementally during operation, and the wear area of each of the sets of pads remains substantially constant.

13. The rotary drag-type drill bit of claim 12 wherein the wearable pads are impregnated with particles of a superhard material.

14. The rotary drag-type drill bit of claim 13 wherein the superhard material is diamond.

15. The rotary drag-type drill bit of claim 14 wherein the diamond comprises natural diamond of a size of from about 2 to about 1000 diamonds per carat.

16. The rotary drag-type drill bit of claim 14 wherein the diamond comprises polycrystalline diamond.

* * * * *